US007823740B2

(12) United States Patent
Perra

(10) Patent No.: US 7,823,740 B2
(45) Date of Patent: Nov. 2, 2010

(54) DEVICE FOR SEALING FOODSTUFF CONTAINERS AND FOODSTUFF CONTAINER PROVIDED WITH SUCH A DEVICE

(75) Inventor: Antonio Giuseppe Perra, Alkmaar (NL)

(73) Assignee: Bound2B B.V. (NL)

( * ) Notice: Subject to any disclaimer, the term of this patent is extended or adjusted under 35 U.S.C. 154(b) by 1525 days.

(21) Appl. No.: 11/035,385

(22) Filed: Jan. 13, 2005

(65) Prior Publication Data

US 2005/0150889 A1 Jul. 14, 2005

Related U.S. Application Data

(60) Provisional application No. 60/536,082, filed on Jan. 13, 2004.

(51) Int. Cl.
*B65D 51/18* (2006.01)

(52) U.S. Cl. ..... 220/254.4; 220/254.3; 220/254.9; 220/821

(58) Field of Classification Search ..... 220/254.1, 220/256.1, 820, 756, 254.3, 816, 821, 254.5; 222/548

See application file for complete search history.

(56) References Cited

U.S. PATENT DOCUMENTS

| | | | | |
|---|---|---|---|---|
| 1,525,032 | A * | 2/1925 | Grady | 222/484 |
| 3,164,286 | A * | 1/1965 | Kole | 220/821 |
| 3,739,938 | A * | 6/1973 | Paz | 220/715 |
| 3,845,880 | A * | 11/1974 | Cole, Jr. | 220/258.5 |
| 4,077,538 | A * | 3/1978 | Waterbury | 220/268 |
| 4,125,203 | A * | 11/1978 | Sovari et al. | 220/255.1 |
| 4,127,212 | A * | 11/1978 | Waterbury | 220/255.1 |
| 4,171,060 | A * | 10/1979 | Howard et al. | 220/254.4 |
| 4,183,443 | A * | 1/1980 | DeParales et al. | 220/714 |
| 4,685,849 | A * | 8/1987 | LaBarge et al. | 413/22 |
| 4,712,704 | A * | 12/1987 | Ramsey et al. | 220/254.4 |
| 4,792,054 | A * | 12/1988 | Weidman | 222/23 |
| 5,186,353 | A * | 2/1993 | Ramsey | 220/711 |
| 5,242,075 | A * | 9/1993 | Ott et al. | 220/361 |
| 5,692,633 | A * | 12/1997 | Gordon | 220/253 |
| 6,202,877 | B1 * | 3/2001 | La Torre et al. | 220/254.1 |
| 6,216,904 | B1 * | 4/2001 | Cagan | 220/253 |
| 6,220,470 | B1 * | 4/2001 | McHenry et al. | 220/254.4 |
| 6,332,551 | B1 * | 12/2001 | Copeland | 220/262 |
| 6,619,499 | B1 * | 9/2003 | Lin | 220/371 |
| 6,626,314 | B1 * | 9/2003 | McHenry et al. | 220/254.2 |
| 6,651,833 | B2 * | 11/2003 | Sciarini | 215/236 |
| 6,739,471 | B2 * | 5/2004 | Goetz et al. | 220/258.4 |

(Continued)

FOREIGN PATENT DOCUMENTS

EP 1 145 674 A 10/2001

(Continued)

*Primary Examiner*—Anthony Stashick
*Assistant Examiner*—Christopher B McKinley
(74) *Attorney, Agent, or Firm*—The Webb Law Firm

(57) ABSTRACT

The invention relates to a device for sealing foodstuff containers, in particular drink containers, comprising: a sealing element adapted to engage on a wall of a foodstuff container around a wall opening arranged in the wall, and an operating element adapted to co-act with the sealing element for displacing the sealing element between an opened position leaving the wall opening clear and a closed position sealing the wall opening. The invention also relates to a foodstuff container provided with such a device.

27 Claims, 8 Drawing Sheets

U.S. PATENT DOCUMENTS

| | | | | |
|---|---|---|---|---|
| 6,854,615 | B2 * | 2/2005 | von Ronn et al. | 220/253 |
| 7,201,288 | B2 * | 4/2007 | von Ronn et al. | 220/253 |
| 2002/0030053 | A1 * | 3/2002 | Copeland | 220/253 |

FOREIGN PATENT DOCUMENTS

| | | | |
|---|---|---|---|
| EP | 1145674 | A | 10/2001 |
| GB | 2 359 068 | A | 8/2001 |
| GB | 2359068 | A | 8/2001 |
| WO | WO 03/004370 | A1 | 1/2003 |

* cited by examiner

DEVICE FOR SEALING FOODSTUFF CONTAINERS AND FOODSTUFF CONTAINER PROVIDED WITH SUCH A DEVICE

CROSS REFERENCE TO RELATED APPLICATION

This application claims the benefit of Provisional Application No. 60/536,082, filed Jan. 13, 2004, entitled "Device for Sealing Foodstuff Containers and Foodstuff Container Provided with such a Device".

BACKGROUND OF THE INVENTION

1. Field of the Invention

The invention relates to a device for sealing foodstuff containers, in particular drink containers, comprising: a sealing element adapted to engage on a wall of a foodstuff container around a wall opening arranged in the wall, and an operating element adapted to co-act with the sealing element for displacing the sealing element between an opened position leaving the wall opening clear and a closed position sealing the wall opening, the operating element being provided with coupling means for coupling to the foodstuff container, wherein the relative orientation of the sealing element and the operating element can be changed such that the operating element can cause the sealing element in the closed position to engage under bias on the wall for substantially medium-tight sealing of the foodstuff container. The invention also relates to a foodstuff container provided with such a device.

2. Description of Related Art

Reclosable liquid containers have already been known for a long time. The American patent specification U.S. Pat. No. 4,077,538 thus describes a reclosable can for drinks or other foodstuffs. The known can is closed at the top by a seam-folded upper wall or cover. The upper wall is herein provided with a wall opening for passage of drink held in the can. The can is further provided with a device connected to the upper wall for closing the can. The device herein comprises a rotatable sealing element and a standing operating element connected to the sealing element. The sealing element is preferably constructed from a non-permeable lip which, after rotation of the operating element, can cover or leave clear the wall opening whereby the passage of drink can thus be respectively prevented or made possible. The advantage of the known can is that the can is reclosable, whereby the content of the can does not have to be consumed all at once but can, if desired, be consumed in portions at different times. Closing the passage opening of the can by means of the lip does somewhat enhance conservation of the content of the can, but mainly prevents the content of the can leaving or being able to leave the can in simple manner. As well as the above stated advantage, the known can also has drawbacks. A significant drawback of the known can is that only mediocre sealing of the can is realizable. The sealing element cannot seal the can completely in liquid-tight manner, or can do so only briefly. In the sealing situation of the can the content of the can is however still accessible to micro-organisms and gas exchange can take place freely between the atmosphere surrounding the can and the local atmosphere prevailing in the can. Particularly when the drink held in the can is carbonated, whereby an internal pressure will be built up in the can, the sealing element will be unable to seal the can sufficiently, as a result of which the carbon dioxide can and will escape. As already generally known, a reduction in the carbon dioxide content of drink results in a—usually unwanted—change in the taste of this drink.

An improved device for sealing beverage containers, in particular beverage containers filled with a carbonated beverage, is disclosed in the American patent specification U.S. Pat. No. 6,626,314. This device comprises an operating element and a sealing element which are mutually coupled by means of a screw connection via a central wall opening in the wall of the beverage container. By rotating the operating element the sealing element can be lowered or raised thereby clearing respectively blocking another wall opening to open respectively seal the beverage container. Although with the known device a significantly improved closure for (carbonated) beverage containers is provided, the known device also has multiple drawbacks. A first major drawback of the device is that the device is constructively relatively complex. Due to this constructive complexity the prime costs to manufacture the known device are commonly considerable. Moreover, since the top wall of the beverage container is provided with multiple wall openings the device is relatively sensitive for leakage and which is to the prejudice of the reliability of the known device.

SUMMARY OF THE INVENTION

The invention has for its object, while retaining the above stated advantage of the prior art, to provide a relatively simple device for sealing a foodstuff container, using which the foodstuff container can be sealed reliably in a substantially medium-tight manner.

The invention provides for this purpose a device for sealing foodstuff containers with the feature that said coupling means being adapted to engage on a peripheral edge of the wall opening around which the sealing element may engage under bias. By adapting the device according to the invention to a single wall opening, instead of to multiple wall openings, a relatively simple device can be obtained, which can be manufactured in a relatively simple and inexpensive manner. Since the single joint (or common) wall opening has a multilateral functionality, whereas the same wall opening is adapted for both passage of foodstuff on one side and for passage of a part of the operating element to allow coupling of the device to the foodstuff container, a relatively efficient device is provided. Moreover, since the single, joint (or common) wall opening is applied, instead of the application of multiple wall openings, the risk of leakage is reduced considerably, thereby making the device relatively suitable and reliable to be applied in combination with beverage containers containing carbonated beverages. The coupling means can be formed for instance by a projecting flange adapted to engage on a side of the wall remote from another part of the operating element. However, preferably the coupling means comprises multiple resilient lips to achieve a solid connection between the operating element and the wall of the foodstuff container. The operating element will thus be partially situated in the wall opening such that the operating element engages bilaterally on the wall. The projecting flange(s) herein lock(s) the mutual position of the operating element relative to the wall. The flange (s) can herein engage on a part of the peripheral edge of the wall opening or can be positioned along the whole peripheral edge of the wall opening. Besides application of the single multifunctional joint wall opening, it is still important that sealing element engages under bias on the wall of the foodstuff container (provided with the wall opening). By causing the sealing element to engage under bias on the wall of the foodstuff container, the foodstuff container is sealed in substantially medium-tight manner. This not only prevents the possibility of the liquid and/or solid foodstuff leaving the foodstuff container in the closed position of the foodstuff container, but also prevents gas exchange being able to take place between an atmosphere surrounding the foodstuff container and an atmosphere prevailing in the foodstuff container. In the case the foodstuff is formed by a carbonated drink, the carbon dioxide will remain confined in the foodstuff container in the closed situation, whereby it will also be possible to maintain the carbon dioxide content in the foodstuff container, which enhances the preservation of taste and the like. Using a device according to the invention it is moreover possible to prevent micro-organisms being able to move, in the closed situation, from outside the foodstuff container to a location inside the foodstuff container. A constant composition of the foodstuff can therefore be guaranteed with the device according to the invention in closed position, wherein the foodstuff can also be conserved in relatively hygienic manner in the closed foodstuff container. In the opened situation of the sealing element, the sealing element is generally situated substantially at a distance from the wall, whereby removal of foodstuff along the sealing element and via the wall opening can take place freely and preferably unimpeded. After sufficient removal of the foodstuff, the sealing element can be displaced once again to the closed position, wherein a bias will be exerted directly or indirectly on the wall in order to realize the medium-tight sealing of the foodstuff container. The bias exerted on the wall by the sealing element can be adjusted in discrete or continuous manner by means of the operating element for a user.

The sealing element and the operating element can be located substantially on one side relative to the wall, but the sealing element and the operating element are preferably adapted to mutually enclose a part of the wall of the foodstuff container. The operating element generally has to be readily accessible to the user and will usually be positioned substantially on an outer side of the wall. The sealing element is preferably located at least substantially inside the foodstuff container. In this manner it is possible to prevent, or at least counter, the sealing part—usually a sealing edge—of the sealing element becoming dirty relatively easily, which is often at the expense of the reliability of the medium-tight sealing.

After removal of a quantity of foodstuff out of the foodstuff container commonly a residue of foodstuff remains within the single multi-purpose wall opening by sticking to the edge of the wall opening, which could easily lead to unhygienic situations. To prevent remaining of a foodstuff residue within the wall opening, the sealing element is preferably designed such that the sealing element is positioned partially within the wall opening in the closed position of the sealing element thereby pushing this residue out of the wall opening. The operating element is preferably provided with a passage opening for the foodstuff held in the foodstuff container. From a hygienic viewpoint the passage opening can more preferably be sealed by a screening element forming part of the sealing element and projecting in the direction of the operating element. This applies particularly in the case liquid foodstuffs, in particular drinks, are held in the foodstuff container. This screening element is preferably congruent to the passage opening formed in the operating element. To facilitate direct consumption of the foodstuff, both the passage opening and the screening element are preferably substantially reniform (or kidney) shaped. The passage opening bounded by the operating element will then generally result in an improved sensation the user when the drink is consumed directly from the foodstuff container, since the operating element—generally manufactured from plastic—will provide a better sensation than the generally sharp peripheral edge of the wall opening. Furthermore, injuries to the user resulting from cuts from the peripheral edge can thus be prevented, or at least countered.

In a preferred embodiment the mutual distance between the sealing element and the operating element can be changed. The mutual co-action of the sealing element and the operating element is herein such that, in the case of translation and/or rotation of the operating element in the closed situation of the device, the sealing element will displace in a direction away from the operating element. In a closed position the sealing element will then rest under bias against the wall around the wall opening, and in an opened position the sealing element will be positioned at least partially, but preferably wholly at a distance of the wall. Because the operating element—after mounting on a foodstuff container—will be coupled by means of coupling means to the foodstuff container, preferably to the wall, the possibility for translation of the operating element relative to the foodstuff container will generally be limited, and will usually even be minimized and become zero. In that case the operating element will only be rotatable relative to the wall. After rotation of the operating element relative to the wall and the sealing element, the sealing element will hereby be forced to displace relative to the wall and the operating element. It is noted that foodstuff container should be interpreted in a broad sense. Understood here are all kinds of conventional containers and packages which are used to conserve foodstuffs. The foodstuffs can herein be formed by (carbonated) drinks, syrups, tablets, sweets, consumable sprinkling materials, etc.

The sealing element preferably engages via a seal on the wall of the foodstuff container which is provided with the wall opening, in the closed position of the sealing element. In order to guarantee the medium-tight sealing in the closed situation of the device, a sealing layer will be advantageous. The seal will generally be formed by a flexible, sealing strip of material which is arranged on a part of the sealing element that is adapted to support under bias on the wall. It is also possible to envisage arranging the sealing strip of material on the wall itself at the location where the sealing element will support in the closed situation. Preferably, the sealing strip is provided with a projecting flange to give the sealing strip a non-planar geometry. It has been found that in this manner, an improved sealing effect can be obtained with the non-planar strip. Various conventional materials can be applied as sealing material. Preferably used is a thermoplastic rubber (TPR), such as a thermoplastic elastomer (TPE), and/or a flexible foam with a closed cell structure. Examples of applicable materials are: ethylene vinyl acetate rubber (EVA), ethylene vinyl ethanol (EvOH) and silicone rubber. The operating element and a remaining part of the sealing element may be made of plastic, such as polyethylene (PE) and polypropylene (PP).

In a preferred embodiment the sealing element engages under bias on, or at least near, a peripheral edge of the wall of the foodstuff container provided with the wall opening in the closed position of the sealing element. In this manner the actual seal is not formed directly around the wall opening, but rather at or at least near the peripheral edge of the wall containing said opening. In this manner a stable, reliable seal can be obtained by means of the device according to the invention, while maintaining a relatively simple construction.

The coupling between the operating element and the sealing element can be of various nature. However, preferably the operating element and the sealing element are mutually coupled by means of a threaded connection. When the relative orientation of the sealing element and the operating element is changed, the mutual distance of the two components will thus also be changed. In addition to screw (thread) connections, the use of other types of co-acting connections can also be envisaged, such as for instance a bayonet connection (bayonet fitting). In a particular preferred embodiment the threaded connection is substantially enclosed by the sealing element and at least one of the wall of the food container and the operating element, at least in the closed position of the sealing element. In this way, fouling of the threaded connection by residue(s) of the foodstuff can be prevented, as a result of which unhygienic situations and malfunctioning of the threaded connection can be prevented. Optionally, at least a part of the threads of the threaded connection is interrupted to allow conditionally a certain degree of venting, in particular de-aeration, between the space within the foodstuff container and the surrounding atmosphere.

In another preferred embodiment the sealing element is provided with at least one receiving space for a pin projecting from the wall. The pin preferably projects in the direction of a space enclosed by the foodstuff container, so as to minimize the number of components protruding in the direction of the user. The pin is preferably formed by a cylindrical body, but can optionally also be designed in another manner. More preferably, the pin is provided with a elongated flattened part for facilitating receipt of the pin by the (substantially cylindrical) receiving space, since liquids eventually contained within the receiving space can be removed relatively easily when receiving the pin. The mutual co-action of the pin and the receiving space prevents rotation of the sealing element. The sealing element is however displaceable along the pin, whereby translation of the sealing element relative to the wall and the operating element, for instance after rotation of the operating element, remains possible. The pin can be formed by a bent and/or folded part of the wall, but may also form part of an intermediate element, for instance a stationary intermediate ring, placed separately between the sealing element and the operating element. The intermediate ring is then preferably connected fixedly to the wall, wherein the pin preferably projects via the wall opening in the direction of the sealing element. To this end, the intermediate ring can be attached by means of injection moulding directly onto the (aluminium) wall of the foodstuff container. The advantage of the intermediate ring is that the existing structure of a conventional foodstuff container need not be changed in order to apply the pin in order to prevent rotation of the sealing element. It is then possible to suffice with an intermediate ring or other type of intermediate element separately manufactured and arranged at a later stage. In order to further stabilize prevention of rotation of the sealing element, a plurality of (spaced-apart) projecting pins may be applied. Preferably, the intermediate ring is provided with a guiding projecting flange to facilitate removal of foodstuff out of the foodstuff container.

The operating element is preferably provided with a projecting engaging member for a user. The projecting engaging member generally facilitates opening and respectively closing of the foodstuff container. The engaging member is preferably formed by a fin-like member. This fin-like member is more preferably slightly curved to facilitate a user to engage the operating element. In addition to serving as a handle, the projecting member can also serve to bound the maximum rotation of the operating element, since in particular foodstuff containers, such as drink cans, the wall opening is arranged asymmetrically in the wall, wherein after a determined rotation the projecting engaging member will engage on a seam-folded part of the wall, whereby further rotation of the operating element can be prevented. An outer edge of the operating element can also be given a profiled form, whereby this outer edge can effectively also function as engaging member for the user. Preferably, substantially all tactile edges and other pointed parts of the operating element, in particular the engaging member, are rounded to prevent injuries by a user, in particular children, when operating the device according to the invention.

The foodstuff container is adapted to contain various kinds of foodstuffs. Certain foodstuffs, such as carbonated beverages, build up pressure within the food container in closed state. To facilitate opening of the pressurized food container, the device is preferably provided with venting means in particular for de-aeration of the foodstuff container via the wall opening. After this de-aeration the device and hence the food container can be opened relatively easily. Particularly in the case of liquid foodstuffs, usually drinks, a venting opening will also be advantageous, particularly during removal of the drink from the drink container. Gurgling removal of drink can thus be prevented, or at least countered. Since de-aeration also occurs via the (joint) wall opening, the wall opening obtains an additional functionality. It may be clear that the venting means can also be used for aeration, instead of de-aeration, of the food container, which may be conceivable in case a vacuum fraction is present within the food container. Preferably, the venting means comprises a first venting member making part of the operating element and a second venting member making part of the sealing element, said second venting member being adapted to co-act with the first venting member such that the mutual orientation of the first venting member and the second venting member can be changed to allow venting respectively block venting through the venting means. Commonly, the first venting member and the second venting member are mutually rotatable, wherein one venting member surrounds the other venting member. Both venting members are commonly provided with a flattened part. In that case, venting is solely possible in case both flattened parts are positioned in line, or are at least positioned such that both flattened parts are in mutual communication.

In a preferred embodiment the device is initially sealed in the closed situation of the device. In this manner a user can ascertain at the time of purchase whether the foodstuff container has previously been (improperly) opened, and whether the content corresponds to a content with specific quality standards guaranteed by the manufacturer. In a particular preferred embodiment the tamper-evident seal is formed by a mutual breakable connection between the sealing element and the operating element. The connection can for instance be formed by a rod and/or by a hook-shaped member. Said hook-shaped member is preferably applied in or near the wall opening to prevent or counter any tampering with the device, wherein the hook-shaped member may be coupled to both an upper surface of the sealing element and a lower surface of the operating element. Besides the functionality as tamper-evident seal, the hook-shaped member can subsequently be used to close the device in a locked member, by fixing the mutual orientation of the operating element and the sealing element. In this latter case, the device can merely be opened by firstly de-hooking the operating element relative to the sealing element. The seal is more preferably visible to the user, so that the user can see at a glance whether or not the device has been opened at an earlier stage. In a particular preferred embodiment, the rod is initially connected to the peripheral edge of the venting opening incorporated in the operating element. The rod is thus visible to the user. During initial opening of the device the rod will be permanently detached from the peripheral edge, whereby the seal is visibly broken and wherein the venting hole can actually function as aeration and venting of the foodstuff container.

In a preferred embodiment the operating element can be fixed relative to the top element in at least one preferred position, in which the sealing element, co-acting with the operating element, is at least substantially situated in the closed position. The device can thus be closed in locked manner, whereby undesired and unexpected changes of the relative orientation of the sealing element and the operating element from a closed position to an open position can be prevented. The device according to the embodiment can thus not be opened in uncontrolled manner by for instance a (slight) external load, but only by one or more controlled operations, which are performed—in an optionally specific sequence—by a user. If the user fixes the relative orientation of the operating element and the sealing element, further removal of the foodstuff, such as a beverage, from the device will thus only be possible after release of the sealing element fixed relative to the operating element. It is also conceivable that other states of the device, besides the closed state, may be lockable. It is therefore for example imaginable that the open state of the device is also lockable, or at least restricted, to prevent excessive opening of the device, which could lead to malfunctioning of the device.

The sealing element is preferably provided with reinforcement means. The reinforcement means preferably comprises a single or multiple reinforcement ribs, thereby each rib extending in a radial direction of the sealing element. In this manner, the sealing element is provided sufficient strength and stiffness to resist internal pressures more than 7 bar. Moreover, the ribs can be used as gate during manufacturing of the sealing element by injection moulding.

In another preferred embodiment the device is provided with barrier means for substantially preventing scouring water and other compounds to enter the foodstuff container in the closed position of the sealing element. During manufacturing of the assembly of the foodstuff container and the device commonly the assembly is cleaned by scouring water. Moreover, the foodstuff contained by the foodstuff container is often pasteurised by the (hot) scouring water. To prevent the scouring water from entering the assembly, the barrier means are provided. This barrier means may be formed e.g. by a rubber strip, e.g. made of TPE or TPR, or by a labyrinth. Preferably, the operating element and the barrier means as a two-components-system is preferably manufactured in a single process step by particular injection moulding. Commonly, this barrier means is applied after filling of the container and before pouring or pasteurising (the content of) the container.

The invention also relates to a foodstuff container provided with such a device according to the invention. As already noted, the device can be applied in diverse types of (substantially) conventional foodstuff container. The device is preferably positioned in an upper wall of the foodstuff container, since removal of the relevant foodstuff generally takes place via the upper wall of the foodstuff container. The foodstuff container is preferably formed by a drink container such as, for instance, a bottle, carton or can. In a drink container the wall opening through which the drink can be removed is generally also situated on the upper wall, or at least one of the upper walls of the relevant drink container. The device will usually already be connected to the upper wall during the manufacturing process of the relevant drink container. During manufacture of a drink can, a cover will first of all be provided with the device according to the invention, before the cover is seam-folded onto a body filled with drink.

BRIEF DESCRIPTION OF THE DRAWINGS

The invention will be elucidated on the basis of the non-limitative embodiments shown in the following Figs. herein.

DESCRIPTION OF THE PREFERRED EMBODIMENTS

Figure 1A:
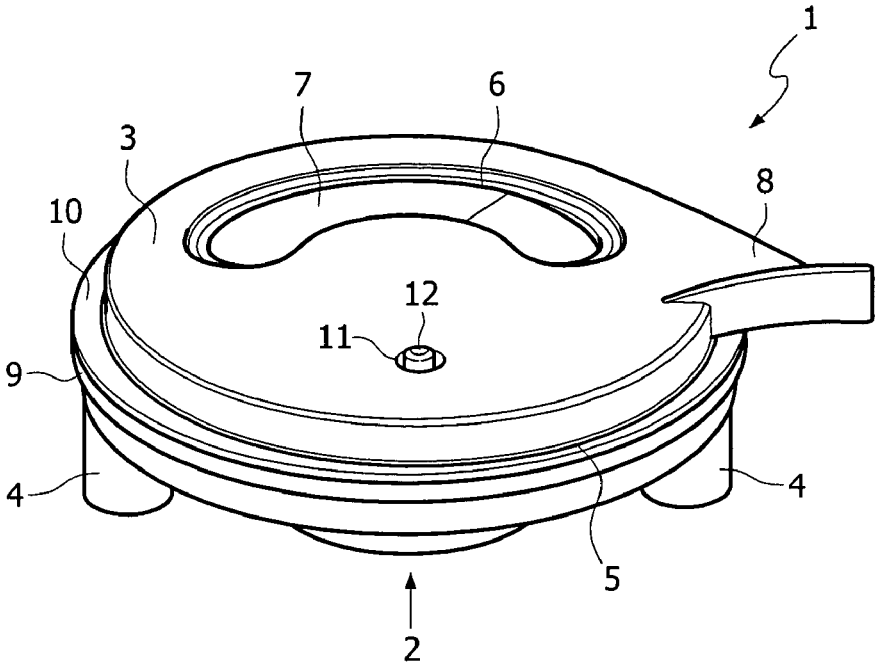
FIG. 1*a* shows a perspective view of a device for closing a foodstuff container according to the invention.

FIG. 1*a* shows a perspective view of a device 1 for closing a foodstuff container (not shown) according to the invention in closed situation. The device 1 comprises a sealing element 2 and an operating element 3 connected rotatably to sealing element 2. Sealing element 2 is adapted to be positioned inside the foodstuff container, and operating element 3 (for a user) is adapted to be positioned outside the foodstuff container. Sealing element 2 and operating element 3 mutually co-act by means of a screw thread connection (see FIGS. 1*b*-1*d*). The mutual distance between operating element 3 and sealing element 2 can be changed by means of rotating the operating element 3 relative to sealing element 2. In order to prevent simultaneous rotation of sealing element 2 during rotation of operating element 3, sealing element 2 is locked two-dimensionally by means of two stationary pins (see FIGS. 1*c* and 1*d*). The pins herein form part of an intermediate ring (see FIGS. 1*c* and 1*d*). Sealing element 2 is provided for this purpose with two receiving spaces 4 for the two pins. Operating element 3 is provided with a projecting coupling flange 5 for clamping the operating element 3 in a wall opening of the foodstuff container. Operating element 3 is provided with a moon-shaped passage opening 6 for the foodstuff held in the foodstuff container. In the shown closed situation of device 1, the passage opening is filled by a likewise moon-shaped projection 7 in order to enable hygienic sealing of the space situated below operating element 3. Operating element 3 is provided with a fin-like projection 8 to facilitate rotation of operating element 3 by the user. In the shown situation the device 1 is closed, whereby removal of foodstuff from the foodstuff container will not be possible. After arranging the shown device 1 on the wall of the foodstuff container, an edge 9 forming part of sealing element 2 will support under bias on the wall, whereby a medium-tight sealing of the foodstuff container can be realized. In the shown device 1 however, there is no physical contact present between the edge 9 of sealing element 2 and the wall, since a sealing layer 10 is arranged between the two. This layer 10 can be fixed by means of an adhesive to the wall or to the edge 9 of sealing element 2. Operating element 3 is provided with a venting opening 11 in order to facilitate removal of—particularly liquid—foodstuff. In venting opening 11 a free end of a rod 12 connected to sealing element 2 is now visible. The rod will break and/or deform permanently once the operating element 3 is rotated relative to sealing element 2. Rod 12 therefore functions in fact as an indicator of whether the device 1 is still sealed or not. Device 1 is arranged in the shown situation on the foodstuff container and marketed commercially as an assembly. Device 1 is preferably manufactured wholly, or in any case at least partially, from plastic. It is also conceivable to manufacture the device 1 from a different material, such as for instance metal.

Figure 1B:
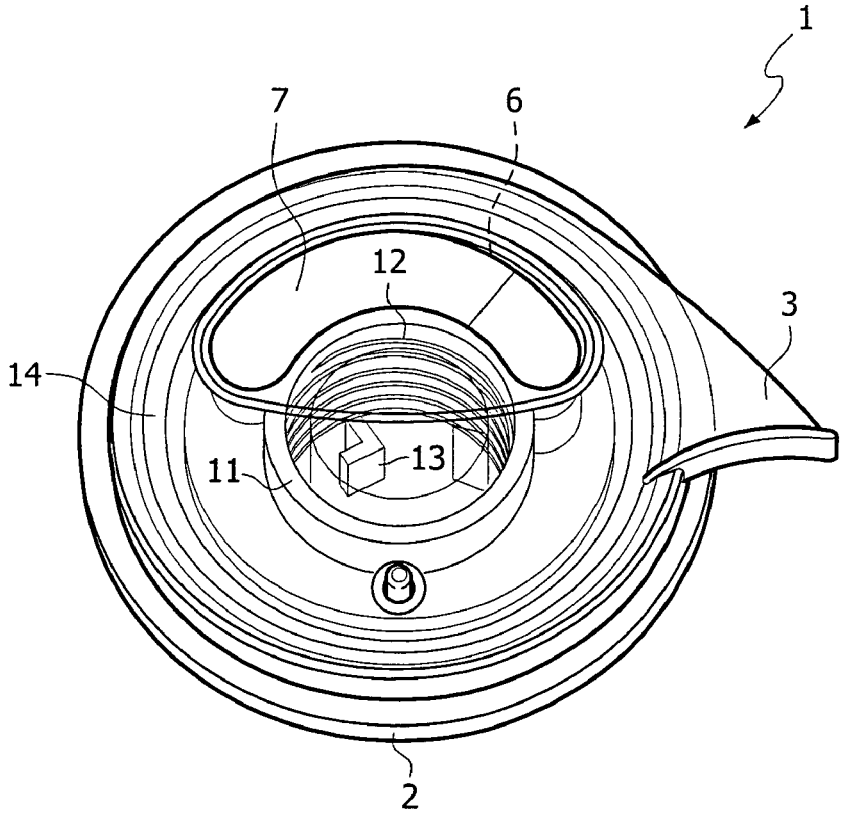
FIG. 1*b* shows a semi-transparent, perspective top view of the device according to FIG. 1*a*.

FIG. 1*b* shows a semi-transparent perspective top view of the device 1 of FIG. 1*a*. In the present view the operating element 3 is shown semi-transparently. The other components are shown in the normal situation of device 1. FIG. 1*b* shows clearly that the sealing element is provided with a centrally located tubular member 11 provided with an internal screw thread 12. The tubular member 11 is also provided with a protrusion 13 located at a distance from screw thread 12 for the purpose of bounding the maximum relative rotation of operating element 3 and sealing element 2. In the present embodiment the maximum angle of rotation amounts to (substantially) 120°. An opposite boundary of this maximum angle of rotation is formed by the moon-like projection 7, which is bounded in the closed situation by mutual co-action with passage opening 6. The mutual distance between screw thread 12 and protrusion 13 is here minimally the wall thickness of a projecting tubular member which forms part of operating element 3 and which is provided with an external screw thread (see FIG. 1*c*). Also shown clearly in FIG. 1*b* is the intermediate ring 14, which is positioned concentrically relative to sealing element 2. The intermediate ring 14 is usually manufactured from plastic and is generally connected fixedly to the wall of the foodstuff container.

Figure 1C:
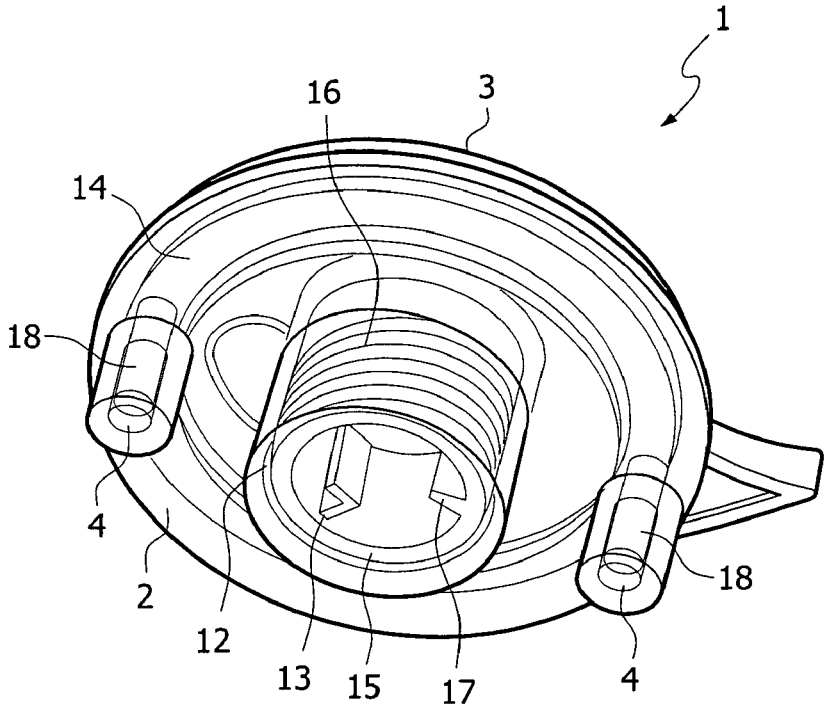
FIG. 1*c* is a semi-transparent, perspective bottom view of the device according to FIGS. 1*a* and 1*b*.

FIG. 1*c* shows a semi-transparent, perspective bottom view of the device 1 of FIGS. 1*a* and 1*b*. In FIG. 1*c* the sealing element 2 is shown semi-transparently. The other components of device 1 are however shown normally. In the present Fig. the projecting tubular body 15 forming part of operating element 3 is clearly shown. The body 15 is herein provided with an external screw thread 16 and is provided on an inner side with a projecting counter-protrusion 17. Screw thread 16 is adapted to co-act with the screw thread 12 forming part of sealing element 2. The counter-protrusion 17 is herein adapted to co-act with the protrusion 13 forming part of sealing element 2, as already stated above. The intermediate ring 14 is now also clearly shown, wherein the intermediate ring is provided with the above mentioned pins 18. Pins 18 are herein received in the receiving spaces 4 of sealing element 2, whereby only one-dimensional displacement of sealing element 2 is possible during rotation of operating element 3.

Figure 1D:
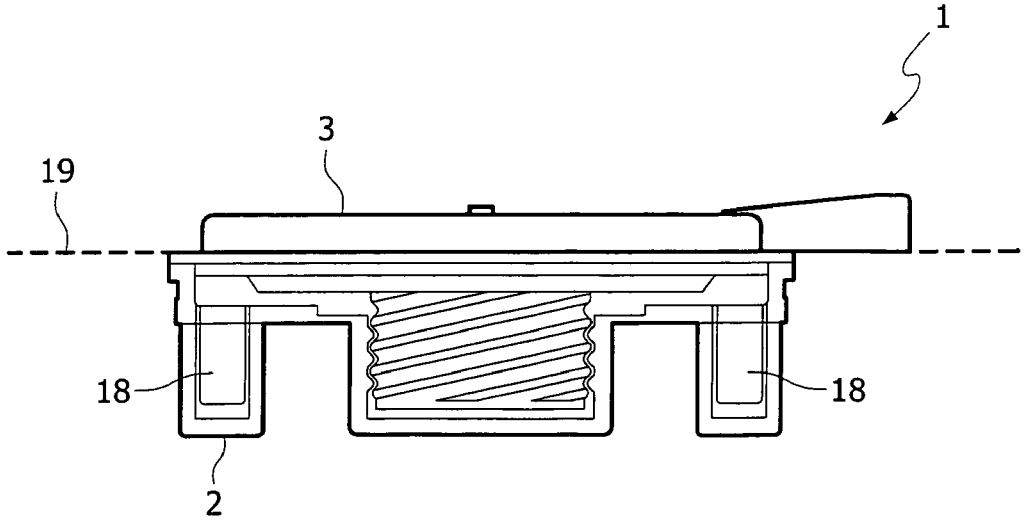
FIG. 1*d* is a semi-transparent side view of the device according to FIGS. 1*a*-1*c*.

FIG. 1*d* shows a semi-transparent side view of the device 1 of FIGS. 1*a*-1*c*. Sealing element 2 is once again shown semi-transparently. The wall of the foodstuff container is now shown by means of a broken line 19. After rotation of operating element 3, sealing element 2 will be displaced linearly along the pins 18 in a (downward) direction away from operating element 3, whereby sealing element 2 comes to lie at a distance from wall 19. In this opened situation the foodstuff can be removed along the sealing element and via the wall opening (not shown). In an alternative embodiment the pins 18 are formed integrally by a deformed part of the wall of the foodstuff container. Pins 18 can thus be formed by downward deformation of (punched) parts of the foodstuff container, whereby a passage opening for the foodstuff is also provided situated between pins 18.

Figure 2A:
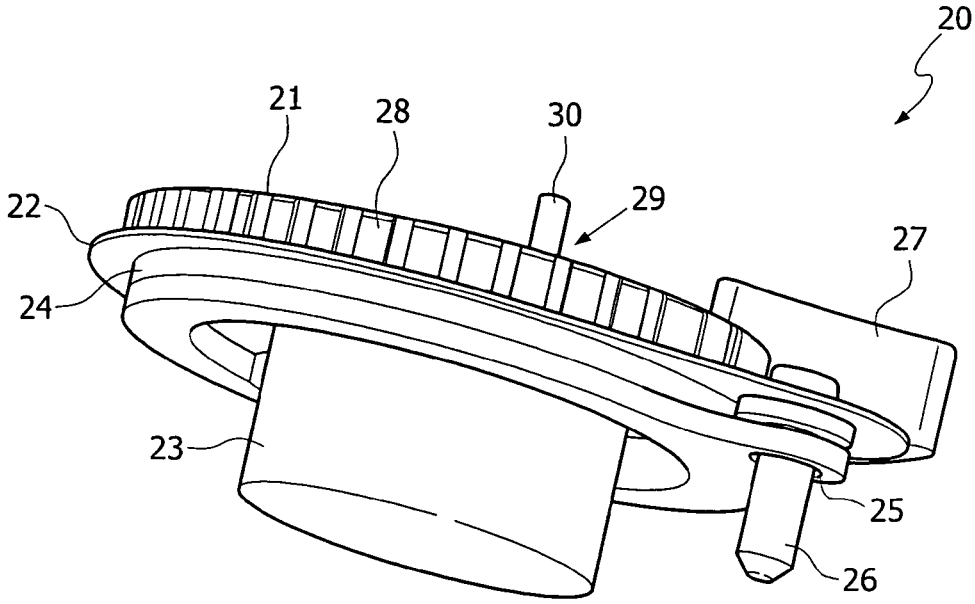
FIG. 2*a* shows a perspective view of another device according to the invention in the closed situation.

FIG. 2*a* shows a perspective view of another device 20 according to the invention in the closed situation. The operation very largely corresponds with the operation of the device 1 shown in FIGS. 1*a*-1*d*. Device 20 comprises a top element 21, an intermediate layer 22 rotatably connected to top element 21, and a cover element 23 co-acting with top element 21 and intermediate layer 22. Arranged between intermediate layer 22 and cover element 23 is a sealing ring 24, which is connected to intermediate layer 22. Cover element 23 is provided with a receiving opening 25 for a pin 26 forming part of intermediate layer 22. Top element 21 is provided with a handgrip 27 and a profiled edge 28 to facilitate rotation of top element 21. Top element 21 is also provided with a venting opening 29 in which a flexible rod-like member 30 is received in the closed situation. The rod-like member 30 in fact seals the venting opening 29 in the closed situation. When top element 21 is rotated relative to intermediate layer 22 and cover element 23, the rod-like member 30 will be removed from venting opening 29. The cover element will simultaneously be displaced linearly along the pin 26, whereby removal of the relevant foodstuff, usually drink, from the foodstuff container can take place along cover element 23 and via intermediate layer 22 and a passage opening 32 arranged in top element 21 (see FIG. 2*b*).

Figure 2B:
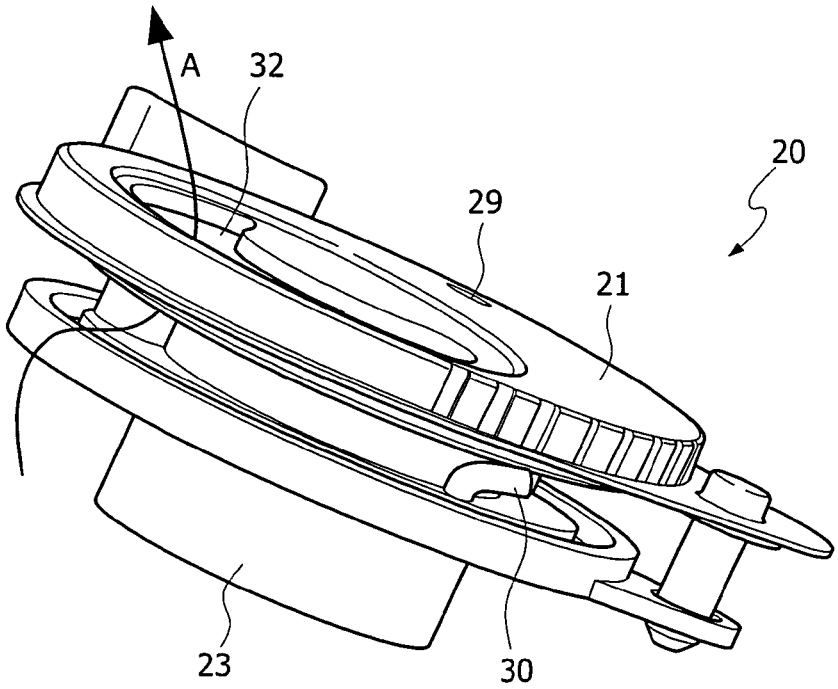
FIG. 2*b* shows a perspective view of the device according FIG. 2*a* in the opened situation.

FIG. 2*b* shows a perspective view of the device 20 of FIG. 2*a* in the opened situation. FIG. 2*b* shows clearly that top element 21 and cover element 23 are located a distance from each other, whereby removal of foodstuff from the foodstuff container can take place (see arrow A). Also shown is that rod-like member 30, temporarily deformed, rests against an underside of top element 21 until top element 21 is rotated back to the situation shown in FIG. 2*a*, after which the rod-like member 30 will once again extend into venting opening 29.

Figure 2C:
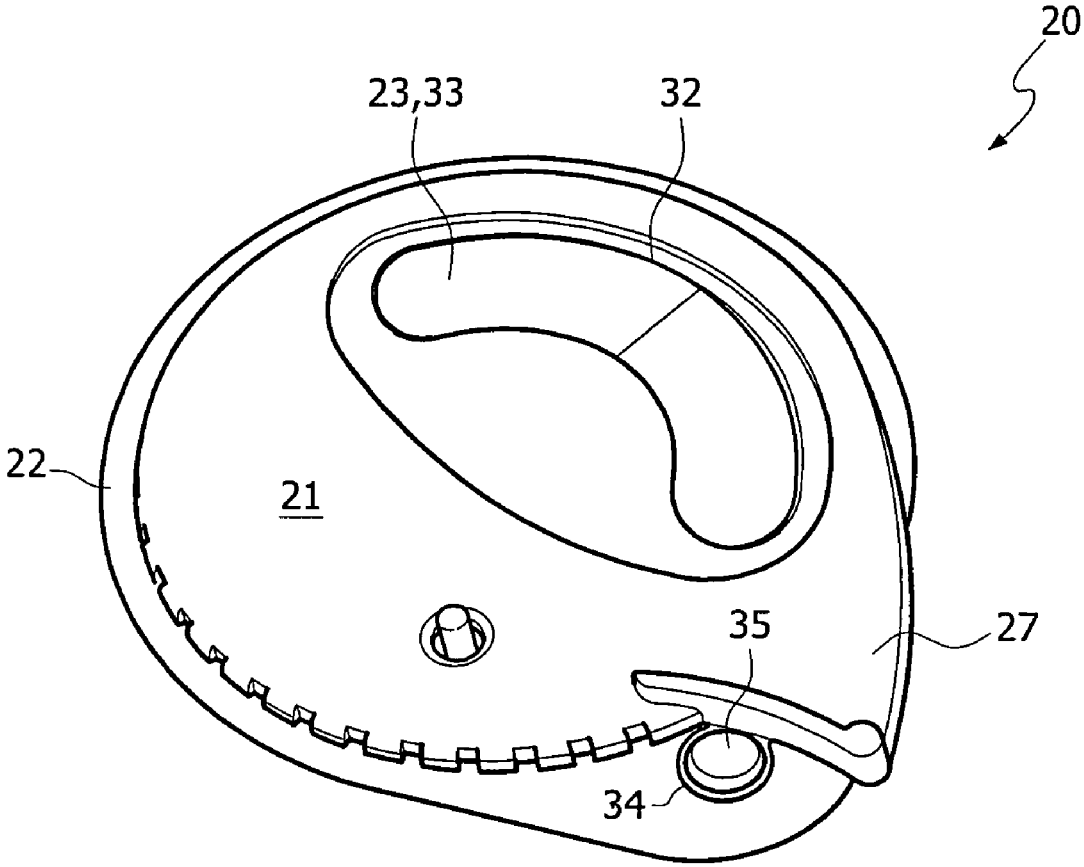
FIG. 2*c* is a perspective top view of the device according to FIGS. 2*a* and 2*b* in closed situation.

FIG. 2*c* shows a perspective top view of the device 20 of FIG. 2*a* and 2*b* in closed situation. In the closed situation the passage opening 32 is sealed by means of a raised part 33 forming part of cover element 23. Also shown is that handgrip 27 is provided with an eye 34 which co-acts with an elevated member 35 arranged in intermediate layer 22. The elevated member 35 prevents the top element 21 from being able to rotate in undesired and simple manner. Only after overcoming a determined bias can the eye 34 be carried over the elevated member 35, whereafter unimpeded rotation of top element 21 through a determined angle is made possible. Top element 21 can in fact therefore be locked in the closed position of device 20.

Figure 3A:
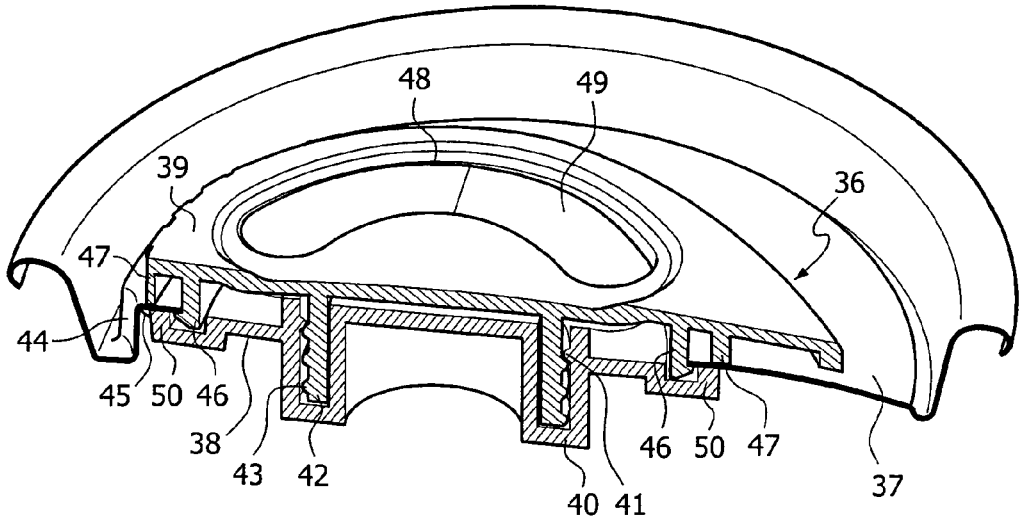
FIG. 3*a* shows a perspective cross-section of an alternative device according to the invention in closed situation.
Figure 3B:
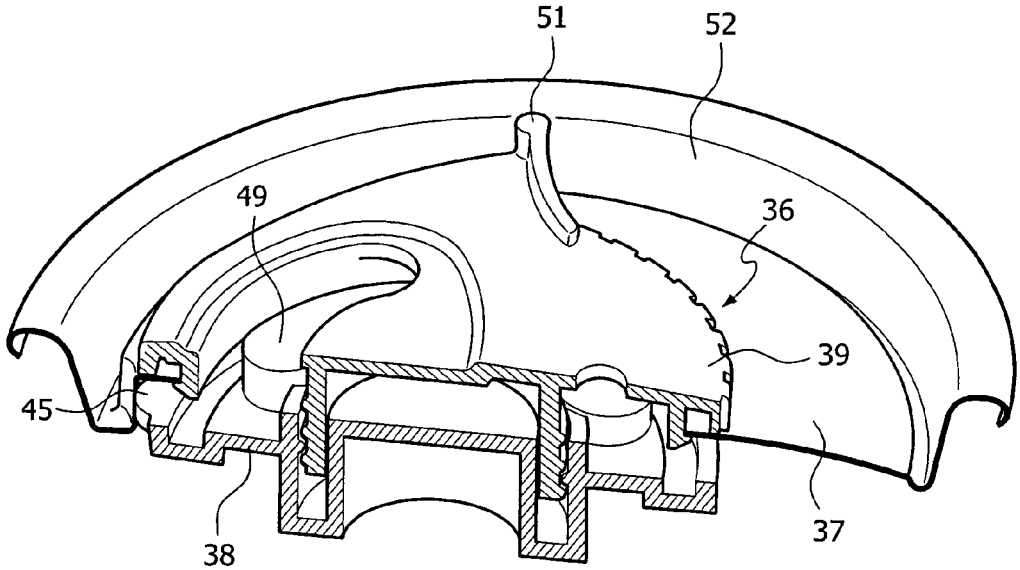
FIG. 3*b* shows a perspective cross-section of the device according to FIG. 3*a* in opened situation.

FIG. 3*a* shows a perspective cross-section of an alternative device 36 according to the invention in closed situation. Device 36 is arranged on a cover 37 of a drink can. Device 36 comprises an internal element 38 and an external element 39 co-acting with internal element 38. Internal element 38 is provided for this purpose with a cylindrical member 40 provided with an internal screw thread 41, and external element 39 is likewise provided with a cylindrical member 42 provided with an external screw thread 43. Rotation of internal element 38 is prevented by locking of internal element 38 on one side. The one-sided locking is realized by mutual co-action of an irregular portion 44 arranged in cover 37 on the one hand and two fixation protrusions 45 forming part of internal element 38 and engaging on either side on the irregular portion 44 on the other. A part of external element 39 is arranged with clamp fitting in a passage opening for drink arranged in cover 37. External element 39 herein engages on cover 37 on two sides. External element 39 is provided for this purpose with a projecting flange 46 for engaging on the inner side of cover 37, and a supporting edge 47 for engaging on an outer side of cover 37. External element 39 is also provided with a drinking opening 48 for a user, which drinking opening 48 is filled in the shown, closed situation by a plunger member 49 forming part of internal element 38. In the shown situation a sealing edge 50 forming part of internal element 38 engages under bias on cover 37. A sealing edge (not shown) is preferably arranged between sealing edge 50 and cover 37 in order to ensure a long-term medium-tight sealing of the drink can. When external element 39 is rotated, internal element 38 will move linearly in a direction away from cover 37, whereafter sealing edge 50 also comes to lie at a distance from cover 37, whereby the can is thus opened and removal of drink is made possible. This opened situation is shown in FIG. 3*b*. In the shown situation the maximum rotation of external element 39 has been reached, as a lip 51 forming part of external element 39 engages on an edge 52 forming part of cover 37. FIG. 3*b* also shows that plunger member 49 of internal element 38 has a surface with an inclining orientation relative to a remaining part of device 36. The higher situated part of plunger member 49 herein forms a boundary to excessive rotation of external element 39 in the direction of the closed position as shown in FIG. 3*a*.

Figure 3C:
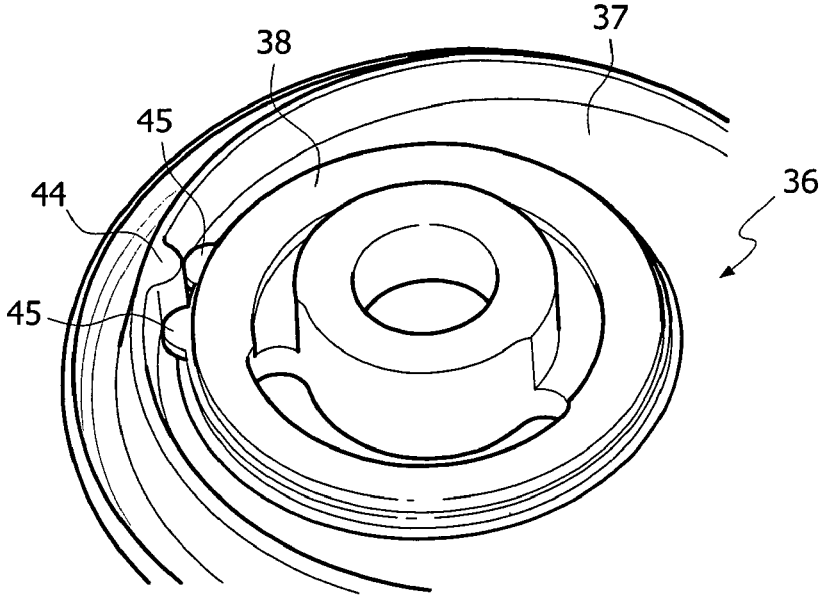
FIG. 3*c* is a perspective bottom view of the device according to FIGS. 3*a* and 3*b* in closed situation.

FIG. 3*c* shows a perspective bottom view of device 36 of FIGS. 3*a* and 3*b* in closed situation. FIG. 3*c* shows in particular the mutual co-action of the irregular portion 44 and the fixation protrusions 45 enclosing the irregular portion 44, whereby rotation of internal element 38 relative to cover 37 and external element 39 can be prevented.

Figure 3D:
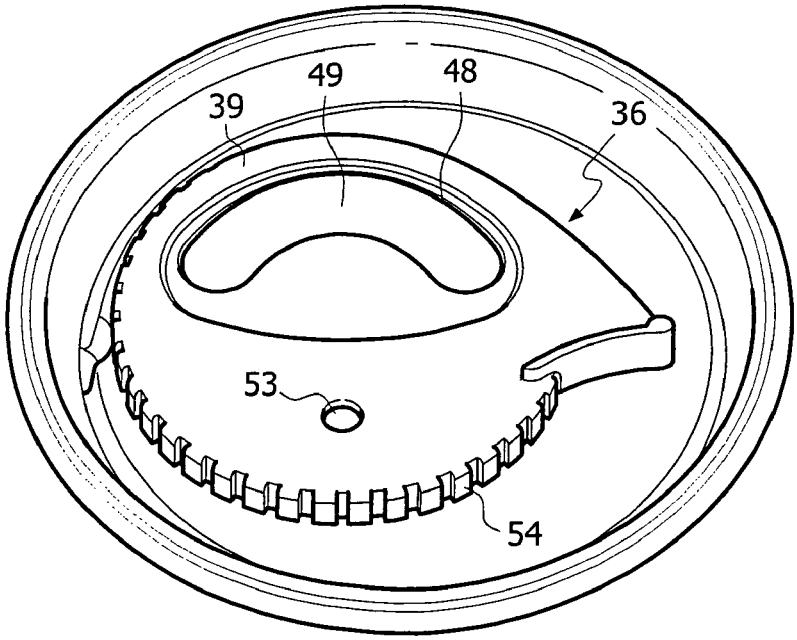
FIG. 3*d* is a perspective top view of the device according to FIGS. 3*a*-3*c* in closed situation.

FIG. 3*d* shows a perspective top view of device 36 of FIGS. 3*a*-3*c* in closed situation. Passage opening 48 of external element 39 is now filled by plunger member 49. FIG. 3*d* also shows that external element 39 is provided with venting opening 53 to make it possible to prevent gurgling removal of drink. External element 39 is moreover provided with a profiled edge 54 to facilitate rotation of external element 39 for the user.

Figure 4:
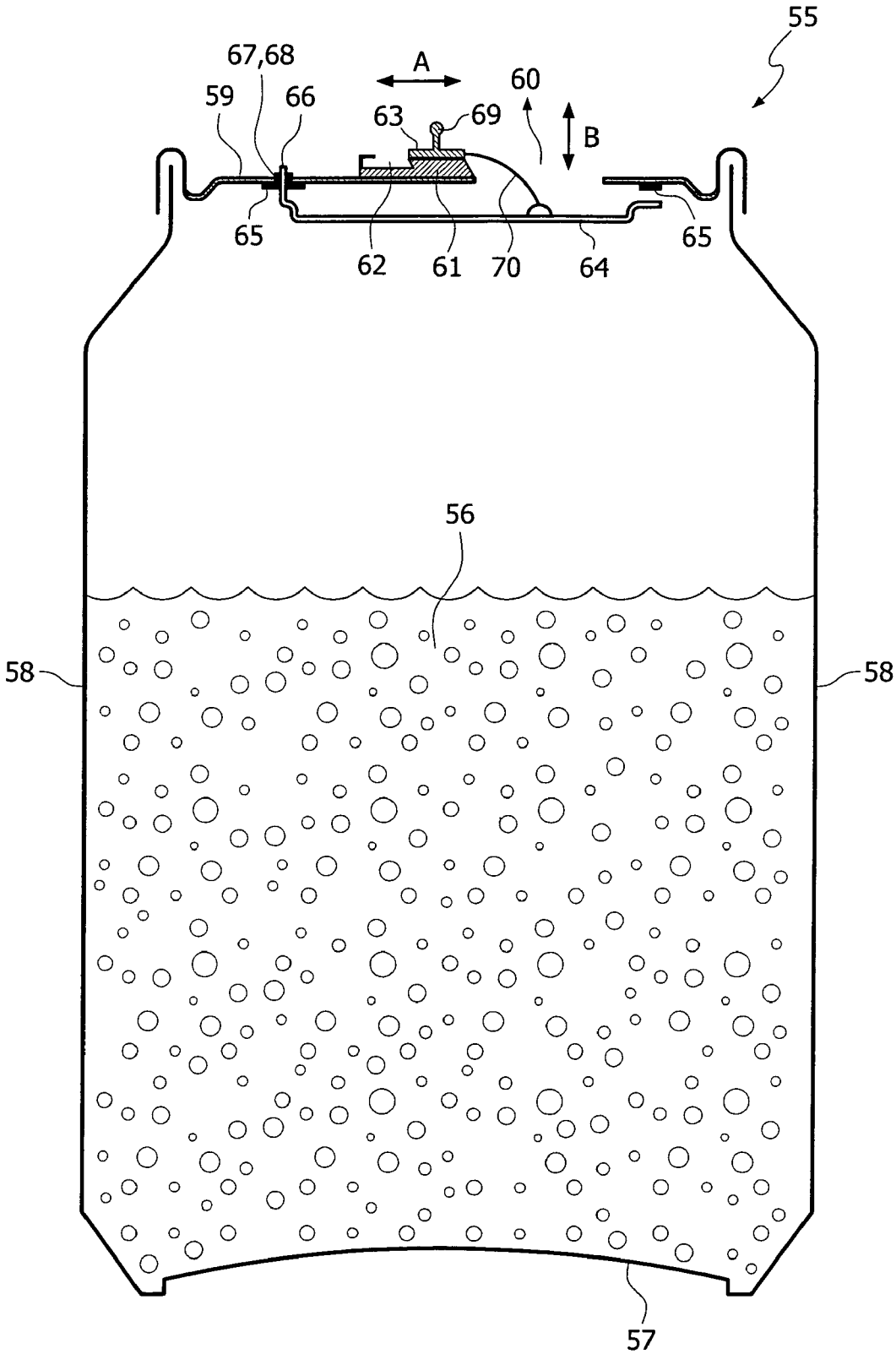
FIG. 4 shows a schematic cross-section of a soft drink can provided with a device according to the invention.

FIG. 4 shows a schematic cross-section of a soft drink can 55 provided with a device 56 according to the invention. Can 55 is filled with a carbonated soft drink 56. Can 55 is constructed from a base element 57, a body 58 connected to base element 57 and a cover 59 seam-folded round body 58. Cover 59 is provided with a passage opening 60 for drink. Device 56 is coupled to cover 59 and is adapted for renewed medium-tight sealing of cover 59. Cover 59 comprises for this purpose a guide means 61 connected fixedly to cover 59 and provided with a receiving space 62 for a slide 63 connected in guiding manner to guide means 61. Slide 63 is coupled by means of a flexible element 64 to a sealing element 64 located in can 55. By sliding the slide 63 along guide means 61 (arrow A) and positioning it on receiving space 62, sealing element 64 can be pulled firmly against cover 59 (arrow B) such that a medium-tight sealing is created. Cover 59 is however now provided with a rubber ring 65 to ensure the medium-tight sealing. So as to stabilize the position of sealing element 64 to some extent, cover element 64 is provided with a pin 66 which protrudes with clamp fitting through an opening 67 arranged in cover 59. A seal 68 is likewise arranged between pin 66 and opening 67. In order to facilitate displacement of slide 63, this latter is provided with a handgrip 69.

Figure 5A:
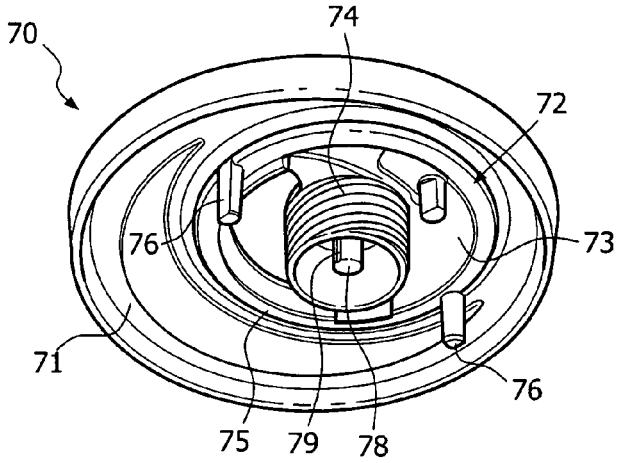
FIG. 5*a* shows a perspective view of an assembly of a wall of a beverage can and a part of a device according to the invention.
Figure 5B:
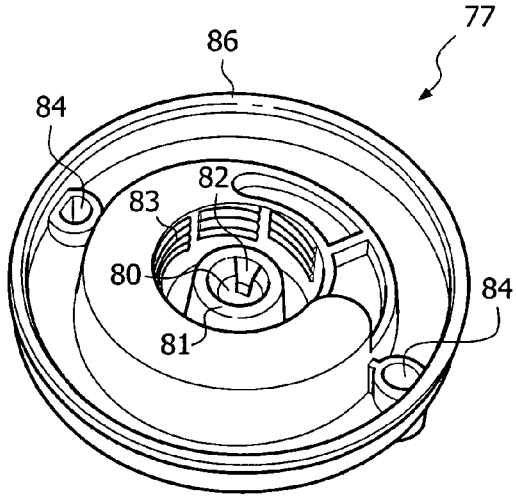
FIG. 5*b* shows a perspective view of an upper side of a complementary part of the device shown in FIG. 5*a*.
Figure 5C:
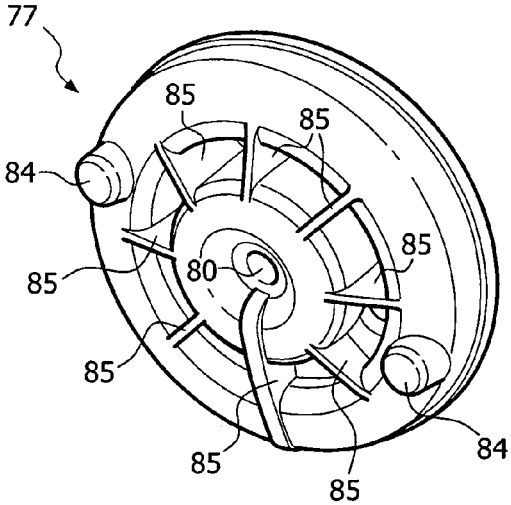
FIG. 5*c* shows a perspective view of a bottom side the complementary part shown in FIG. 5*b*.

FIG. 5*a* shows a perspective view of an assembly 70 of a wall 71 of a beverage can and a part of a device 72 according to the invention. The shown part of the device 72 comprises an operating element 73 provided with an external screw thread 74. The shown part of the device 72 further comprises an intermediate ring 75 provided with two pins 76 extending downwards. Both the operating element 73 and the ring 75 are adapted to be coupled to a sealing element 77 as shown in FIGS. 5*b* and 5*c*. The ring 75 is provided with a rounded edge thereby forming a flange to optimise the sealing capacity of the ring 75. The operating element 73 further comprises a protruding pen 78 provided with a flattened part 79, said pen 78 being adapted to block or clear a venting passage 80 enclosed by the sealing element 77. Said protruding pen 78 may alternatively be provided with a groove instead of a flattened part. As is shown in FIG. 5*b*, the sealing element 77 comprises a protruding hollow cylindrical body 81 adapted to receive said pen 78. Said hollow body 81 is provided with a recess 82 to allow de-aeration of the beverage can via the flattened part 79 of said pen 78. To secure substantially free, unhindered flow of gas during de-aeration of the beverage can an inner screw thread 83 of the sealing element 77 is interrupted. The sealing element 77 also comprises two slots 84 for receiving the pins 76 of the intermediate ring 75. The sealing element 77 is provided with a sealing ring 86 to secure medium-tight engaging of the sealing element onto the wall 71. Said sealing ring 86 is preferably made of a TPE or TPE, while the sealing element 77 is preferably made of a polymer like PE or PP. However, preferably, the sealing element 77 and the sealing ring 86 as a two-components-system is preferably manufactured in a single process step by particular injection moulding. A lower surface of the sealing element 77 is provided with multiple reinforcement ribs 85 to strengthen and stiffen the sealing element to resist relatively high pressures of above 7 bar. The working principle of the device as shown in FIGS. 5*a*-5*c* is substantially identical to the working principle of the device 1 shown in FIGS. 1*a*-1*d* and elucidated above in a comprehensive manner.

It will be apparent that the invention is not limited to the exemplary embodiments shown and described here, but that numerous variants, which will be obvious to the skilled person in the field, are possible within the scope of the appended claims.

What is claimed is:

1. Device for sealing foodstuff containers, in particular drink containers, comprising:

a sealing element adapted to engage on a cover of a foodstuff container around an opening arranged in the cover, and an operating element adapted to co-act with the sealing element for displacing the sealing element between an opened position leaving the opening clear and a closed position sealing the opening, the operating element being provided with coupling means for coupling to the foodstuff container, wherein the relative orientation of the sealing element and the operating element can be changed such that the operating element can cause the sealing element in the closed position to engage under bias on the cover for substantially medium-tight sealing of the foodstuff container, characterized in that said coupling means being adapted to engage on a peripheral edge of the opening, wherein the sealing element is located at least substantially inside of the foodstuff container.

2. Device as claimed in claim 1, characterized in that the operating element is partially situated in the opening such that the operating element engages bilaterally on the cover.

3. Device as claimed in claim 1, characterized in that the sealing element and the operating element are adapted to mutually enclose a part of the cover of the foodstuff container.

4. Device as claimed in claim 1, characterized in that the sealing element is positioned partially within the opening in the closed position of the sealing element.

5. Device as claimed in claim 1, characterized in that the mutual distance between the sealing element and the operating element can be changed.

6. Device as claimed in claim 1, characterized in that the relative orientation of the sealing element and the operating element can be changed by means of rotating the sealing element relative to the operating element.

7. Device as claimed in claim 1, characterized in that the sealing element engages via a seal on the cover of the foodstuff container provided with the opening in the closed position of the sealing element.

8. Device as claimed in claim 1, characterized in that the sealing element engages under bias on, or at least near, a peripheral edge of the cover of the foodstuff container provided with the opening in the closed position of the sealing element.

9. Device as claimed in claim 1, characterized in that the operating element and the sealing element are mutually coupled by means of a threaded connection.

10. Device as claimed in claim 9, characterized in that the threaded connection is substantially enclosed by the sealing element and at least one of the cover of the foodstuff container and the operating element, at least in the closed position of the sealing element.

11. Device as claimed in claim 1, characterized in that the sealing element is provided with at least one receiving space for a pin projecting from the cover.

12. Device as claimed in claim 11, characterized in that the pin forms part of an intermediate element connected to the cover.

13. Device as claimed in claim 1, characterized in that the operating element is provided with a projecting engaging member for a user.

14. Device as claimed in claim 13, characterized in that the projecting engaging member is substantially fin shaped.

15. Device as claimed in claim 1, characterized in that the operating element is provided with a passage opening for the foodstuff held in the foodstuff container.

16. Device as claimed in claim 15, characterized in that the sealing element is provided with a screening element projecting in the direction of the operating element and adapted for positioning in the passage opening in a closed situation of the device.

17. Device as claimed in claim 1, characterized in that the device is provided with venting means in particular for deaeration of the foodstuff container via the opening.

18. Device as claimed in claim 17, characterized in that the venting means comprises a first venting member making part of the operating element and a second venting member making part of the sealing element, said second venting member being adapted to co-act with the first venting member such that the mutual orientation of the first venting member and the second venting member can be changed to allow venting respectively block venting through the venting means.

19. Device as claimed in claim 1, characterized in that the device is initially sealed in the closed situation of the device.

20. Device as claimed in claim 19, characterized in that the seal is formed by a mutual breakable connection between the sealing element and the operating element.

21. Device as claimed in claim 1, characterized in that the operating element can be fixed relative to the sealing element in at least one preferred position, in which the sealing element, co-acting with the operating element, is at least substantially situated in the closed position.

22. Device as claimed in claim 21, characterized in that the operating element can be fixed relative to the sealing element by means of a substantially hook-shaped member.

23. Device as claimed in claim 1, characterized in that the sealing element is provided with reinforcement means.

24. Device as claimed in claim 1, characterized in that the device is provided with barrier means for substantially preventing scouring water and other compounds to enter the foodstuff container in the closed position of the sealing element.

25. Foodstuff container provided with a device as claimed in claim 1.

26. Foodstuff container as claimed in claim 25, characterized in that the foodstuff container is formed by a drink container.

27. Foodstuff container as claimed in claim 26, characterized in that the foodstuff container is formed by a drink can.

* * * * *

UNITED STATES PATENT AND TRADEMARK OFFICE

CERTIFICATE OF CORRECTION

PATENT NO. : 7,823,740 B2
APPLICATION NO. : 11/035385
DATED : November 2, 2010
INVENTOR(S) : Perra It is certified that error appears in the above-identified patent and that said Letters Patent is hereby corrected as shown below:

Column 14, lines 18-19, Claim 18, "changed to allow venting respectively block venting" should read -- changed to allow venting or respectively block venting --

Signed and Sealed this
Twenty-second Day of February, 2011

David J. Kappos

David J. Kappos
*Director of the United States Patent and Trademark Office*